US006704938B2

(12) United States Patent
Crockett

(10) Patent No.: US 6,704,938 B2
(45) Date of Patent: Mar. 16, 2004

(54) METHOD AND APPARATUS FOR ATTACHMENT PROTECTIVE PADS

(76) Inventor: Joseph Crockett, 4916 Austin Dr., Galveston, TX (US) 77551

( * ) Notice: Subject to any disclaimer, the term of this patent is extended or adjusted under 35 U.S.C. 154(b) by 0 days.

(21) Appl. No.: 10/210,373

(22) Filed: Jul. 31, 2002

(65) Prior Publication Data

US 2004/0019949 A1 Feb. 5, 2004

(51) Int. Cl.[7] ..... A41D 13/00
(52) U.S. Cl. ..... 2/23; 2/24
(58) Field of Search ..... 2/24, 23, 16, 267, 2/455, 62, 79, 227, 908, 911; 602/23, 26, 62

(56) References Cited

U.S. PATENT DOCUMENTS

| | | | | | |
|---|---|---|---|---|---|
| 891,533 | A | * | 6/1908 | Gibbs | 2/24 |
| 3,346,877 | A | * | 10/1967 | Zirves | 2/24 |
| 4,099,269 | A | | 7/1978 | Porner | 2/16 |
| 4,561,123 | A | | 12/1985 | Hall | 2/23 |
| 4,893,355 | A | | 1/1990 | Ritter | 2/24 |
| 5,592,689 | A | | 1/1997 | Matthews | 2/23 |
| 5,611,080 | A | * | 3/1997 | Skottheim | 2/16 |
| 5,611,081 | A | | 3/1997 | Torres | 2/23 |
| 6,317,888 | B1 | * | 11/2001 | McFarlane | 2/24 |
| 6,347,403 | B1 | | 2/2002 | Wilcox | 2/23 |

* cited by examiner

*Primary Examiner*—Tejash Patel
(74) *Attorney, Agent, or Firm*—Russell J. Egan

(57) ABSTRACT

A plurality of fasteners is attached spaced around the periphery of a pad, such as a knee or elbow pad, with the fasteners being capable of gripping the ordinary clothing of a worker to secure the pad at the joint to be protected. The fasteners do not damage to material of the clothing, secure the pad in place at all times, and are readily attached to and detached from any ordinary street and/or work clothing. No modification of the clothing is required.

8 Claims, 1 Drawing Sheet

METHOD AND APPARATUS FOR ATTACHMENT PROTECTIVE PADS

BACKGROUND OF THE INVENTION

1. The Field of the Invention

The present invention pertains to a method and apparatus for mounting protective padding on ordinary clothing and, in particular, to mounting protective padding on ordinary clothing in such fashion as to avoid damage to the clothing while not requiring any modification of the clothing.

2. The Prior Art

There are many instances in daily life when it is desirable and/or necessary to have protection on ones person. To date there has been no way to keep protective pads in place on knees and/or elbows without requiring either modification of clothing or using painfully binding limb encircling straps. A large number of work areas require a worker to move about on their knees and this can become quite painful if there is no protective padding provided.

The primary type of protective knee and elbow pads that are readily available comes with the pad attached to an elastic sleeve. The limb is inserted through the sleeve and the elastic is intended to keep the pad in place. However, this type of protection has no guaranty of the pad staying in place as the worker moves around and it becomes quite uncomfortable after a while because the elastic sleeve tends to bunch up behind the knee or inside the elbow.

There have been many attempts to overcome these problems, mainly by using the hook and eye loop fastening system sold under the trademark VELCRO. U.S. Pat. No. 3,465,364 to Edelson discloses a shin guard attachable to a sock by such a VELCRO strip.

U.S. Pat. No. 4,099,269 Porner; U.S. Pat. No. 4,561,123 to Hull; and U.S. Pat. No. 5,592,689 Matthews are representative of the many patents which show knee pads of various sorts attached to the exterior of a garment by means of VELCRO hook and loop fasteners. The primary drawback to these types of arrangements is that they require the garment to be modified by permanent attachment of one portion of a VELCRO hook and loop fastener. This portion of the VELCRO hook and loop fastener is quite unsightly when the pad is not in place thereby limiting the usefulness of the garment. The VELCRO hook and loop fastener does not necessarily assure that the pad will always be in place and becomes a collector of debris when the pad is not in place.

U.S. Pat. No. 4,893,355 to Ritter discloses a different approach to solving the problem by having a knee protector with the ability to rigidly affix itself to the knee of a user without the use of straps or bands. This seems to be a painful way to accomplish the desired result.

U.S. Pat. No. 5,611,081 to Torres discloses a knee and shin pad assembly received in pockets on the fronts of legs of a pair of work pants. The VELCRO hook and loop strips are used to close the pockets, not hold the pads to the pants.

U.S. Pat. No. 6,347,403 to Wilcox discloses a protective knee system having affixing means consisting of a snap fitting or VELCRO hook and loop fasteners integral with the side seam of a pair of pair of pants.

None of the above patents shows of suggests the present invention which provides a method and apparatus for attaching protective padding a worker wearing ordinary work and/or street clothing. All of the prior art requires special modification of work or street clothing which makes the clothing unsuitable for wear without the padding in place, particularly in an environment other than a work site.

SUMMARY OF THE INVENTION

The present invention provides a plurality of fasteners attached around the periphery of a pad, such as a knee or elbow pad, with the fasteners capable of detachably gripping ordinary clothing of the worker to secure the pad at the joint to be protected. The fasteners do not damage to material of the clothing, secure the pad in place at all times, and are readily attached to and detached from any ordinary street and/or work clothing.

BRIEF DESCRIPTION OF THE DRAWINGS

The present invention will now be described, by way of example, with reference to the accompanying drawings, in which.

DETAILED DESCRIPTION OF THE INVENTION

Figure 1:
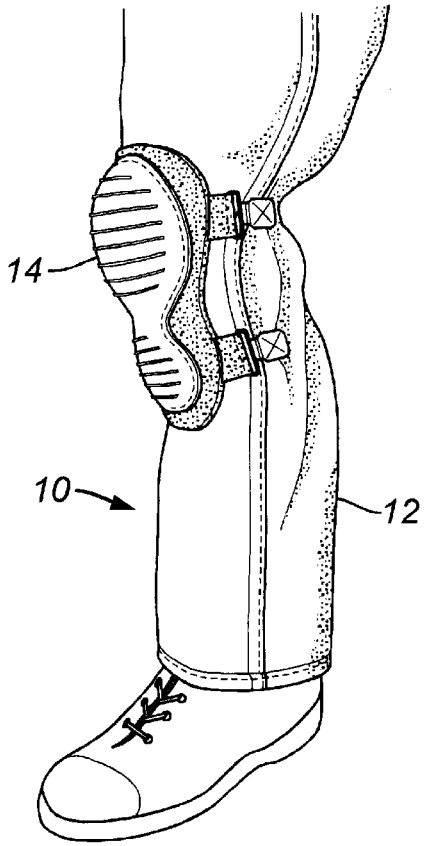
FIG. 1 shows the present invention in use holding a protective knee pad in place.
Figure 2:
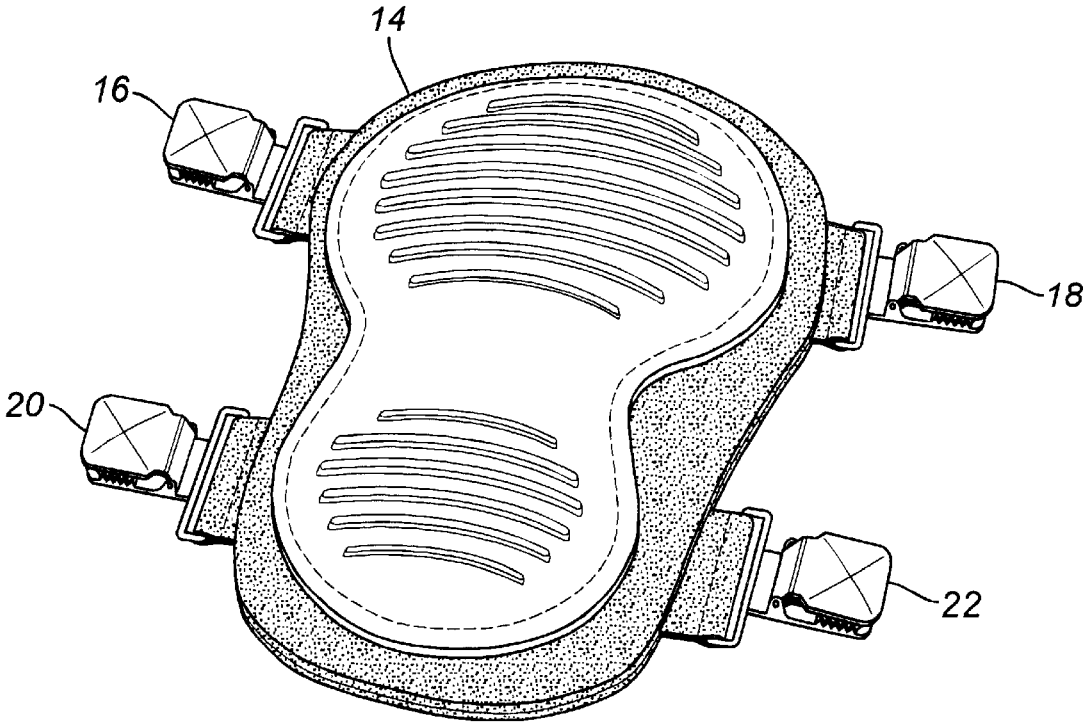
FIG. 2 is a perspective view of a representative knee pad incorporating the subject invention.

Turning now to the drawings, FIG. 1 shows the left leg 10 of a worker wearing an ordinary pair of pants 12, such as khakis or jeans, to which a knee pad 14 has been attached using the principles of the present invention. The knee pad 14 is provided with a plurality of clips 16, 18, 20, 22 attached around the periphery of the knee pad. Each clip is adapted to be attached to the clothing in such fashion as to hold the knee pad in place while not damaging the clothing.

It will be appreciated that the clips that can be used with the present invention come in a wide variety of styles and materials. The only requirement is that they have clothing gripping jaws, which will not damage the clothing, and clamping means to hold the jaws closed on the clothing. The clips may be attached to the protective pad in a number of ways including, but not restricted to, fabric and/or elastic loops or metal rings or combinations thereof The subject invention is not limited to the style of knee pad showing in the drawings. This is merely representative of the many styles of pads including rigid pads, flexible pads, articulated pads, soft pads, and any combination of the foregoing types.

It will be readily apparent that the subject invention can also be used for elbow pads and/or for attaching any other pads to appropriate portions of the wearer. The subject invention allows the pads to be attached to ordinary clothing without modification of the clothing to received the pads, as in the case of the pads attached by VELCRO hook and loop fasteners as discussed above, and assures that the pad will remain in place during use.

The present invention may be subject to many modifications and changes without departing from the spirit or essential characteristics thereof The present specification should therefore be considered in all respects as illustrative and not restrictive of the scope of the present invention as defined by the appended claims.

I claim:

1. A method for attaching pads to clothing, without damaging the clothing or requiring modification thereof so as to provide protection for an underlying joint while not binding or in any way hindering movement of said joint, said method comprising the steps of providing a protective pad having a preformed, articulated, at least semi rigid, outer surface and a padded inner surface with a plurality of fasteners attached spaced along opposite sides of said pad to each side of said articulation, each fastener being capable of gripping ordinary clothing without damaging said clothing or encircling the joint or adjacent limb; and attaching said fasteners to the clothing of a worker so as to place the pad in position protecting a joint.

2. The method according to claim 1 wherein said pad is a knee pad.

3. The method according to claim 1 wherein said pad is an elbow pad.

4. The method according to claim 1 wherein each said fastener comprises:

a pair of opposing clothing gripping jaws, and clamping means adapted to selectively open and close said jaws.

5. An improved protective pad for attachment to clothing without damaging the clothing or requiring modification thereof or causing either restriction of movement of the joint or binding any portion of an adjacent limb said pad comprising:

a protective pad of known configuration having a preformed, articulated, at least semi rigid, outer surface and a padded inner surface; and a plurality of fasteners attached spaced along opposite sides of said pad to each side of said articulation, each said fastener being capable of gripping ordinary clothing without damaging said clothing, at the joint to be protected.

6. The protective pad according to claim 5 wherein said pad is a knee pad.

7. The protective pad according to claim 5 wherein said pad is an elbow pad.

8. The protective pad according to claim 5 wherein each said fastener comprises:

a pair of opposing clothing gripping jaws, and clamping means adapted to selectively open and close said jaws.

* * * * *